United States Patent [19]

Kastner

[11] 4,070,805

[45] Jan. 31, 1978

[54] DISPLACEABLE BUILDING UNIT FOR OFF-THE-WALL GAMES

[76] Inventor: Sid Kastner, 68 Rosemount Crescent, Westmount, Quebec, Canada, H3Y 2C2

[21] Appl. No.: 714,847

[22] Filed: Aug. 16, 1976

[51] Int. Cl.[2] ..... E04B 1/32

[52] U.S. Cl. ..... 52/86; 272/3; 273/95 H; 52/282; 52/270; 52/281

[58] Field of Search ..... 52/86, 346, 347, 348, 52/270, 281, 282, 22; 272/3; 273/95 H

[56] References Cited

U.S. PATENT DOCUMENTS

| | | | |
|---|---|---|---|
| 1,267,084 | 5/1918 | Knox | 52/86 |
| 1,938,680 | 12/1933 | Balduf | 52/346 |
| 2,065,433 | 12/1936 | Percum | 52/281 |
| 2,107,141 | 2/1938 | Colt | 272/3 |
| 2,205,398 | 6/1940 | Eaton | 272/3 |
| 2,872,882 | 2/1959 | Paul | 52/396 |
| 3,332,192 | 7/1967 | Kessler | 52/588 |
| 3,845,592 | 11/1974 | Patena | 52/93 |

FOREIGN PATENT DOCUMENTS

| | | | |
|---|---|---|---|
| 1,509,652 | 1/1968 | France | 52/588 |
| 401,422 | 3/1966 | Switzerland | 52/588 |
| 549,051 | 11/1942 | United Kingdom | 52/22 |

*Primary Examiner*—Price C. Faw, Jr.
*Assistant Examiner*—Henry Raduazo

[57] ABSTRACT

A displaceable knocked-down building unit defining a playing enclosure for use as a court for off-the-wall games. The unit has rigid external skeleton structures on the inside of which are secured wall panels thereby defining the playing enclosure. The means securing the wall panels of at least one wall which is to serve as the ball-bouncing wall are secured wholly on the outside of the panels whereby the said panels form an inner face for ball-bouncing purposes which is flat, continuous and devoid of projecting parts.

8 Claims, 12 Drawing Figures

FIG. 6
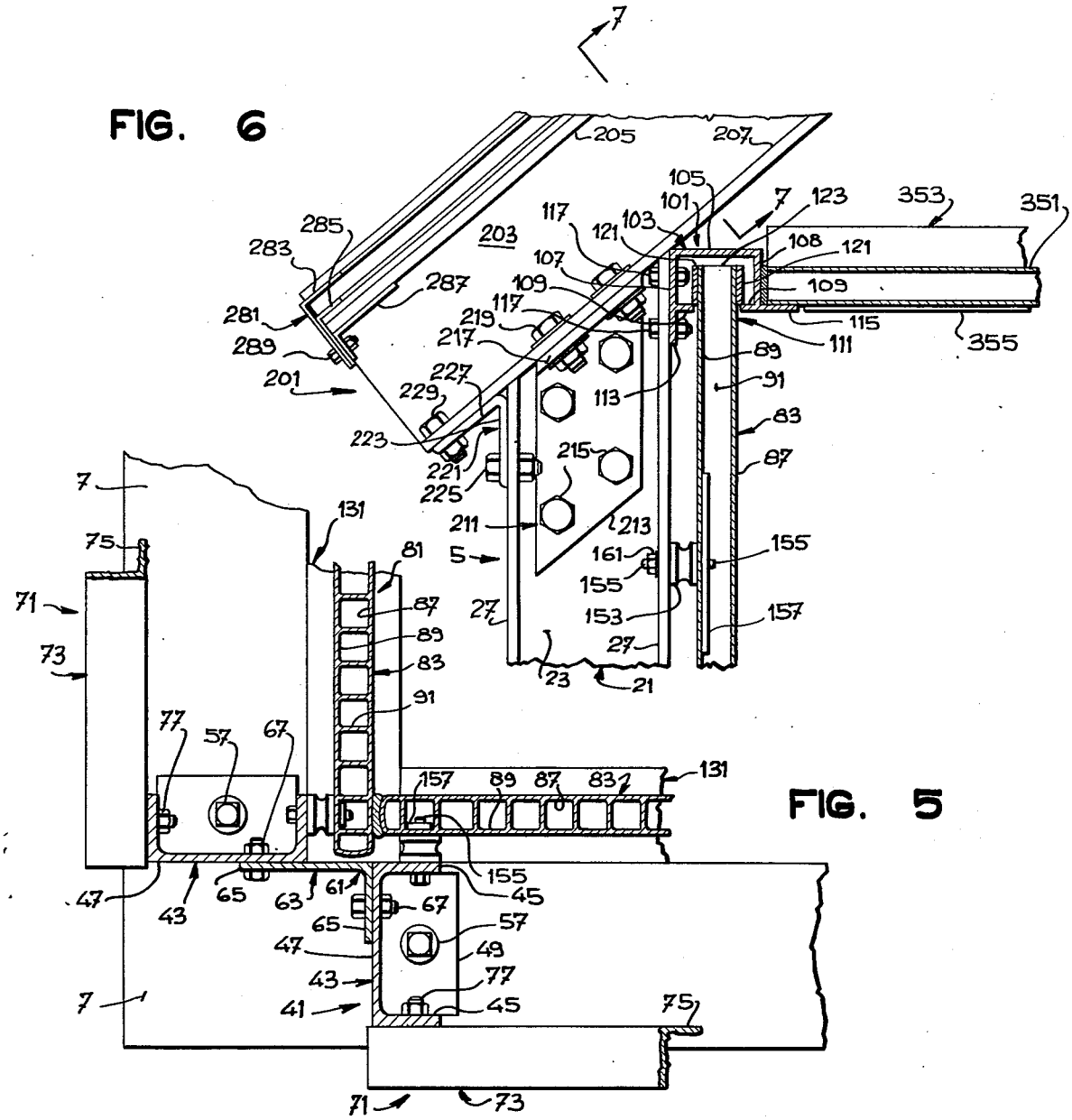
FIG. 5
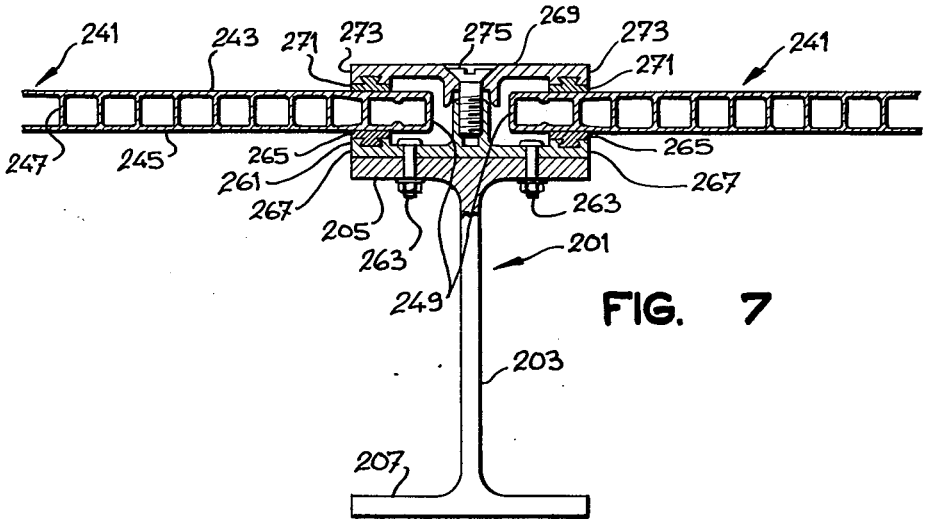
FIG. 7

FIG. 8
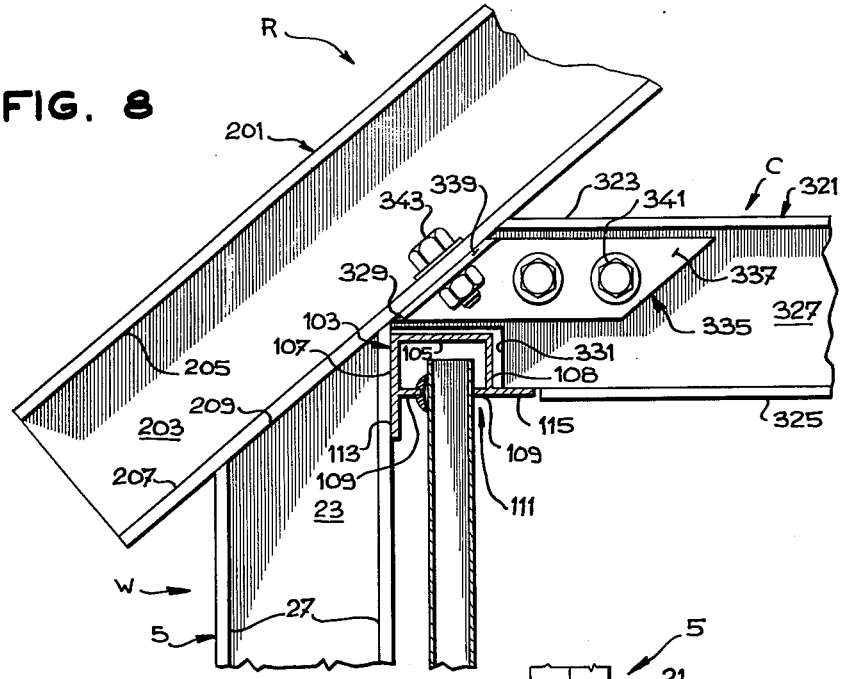
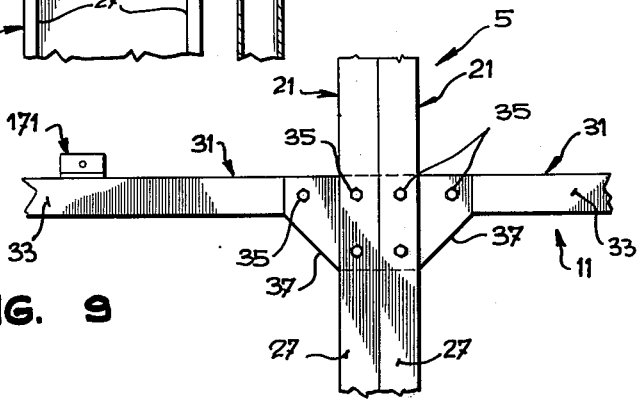
FIG. 9
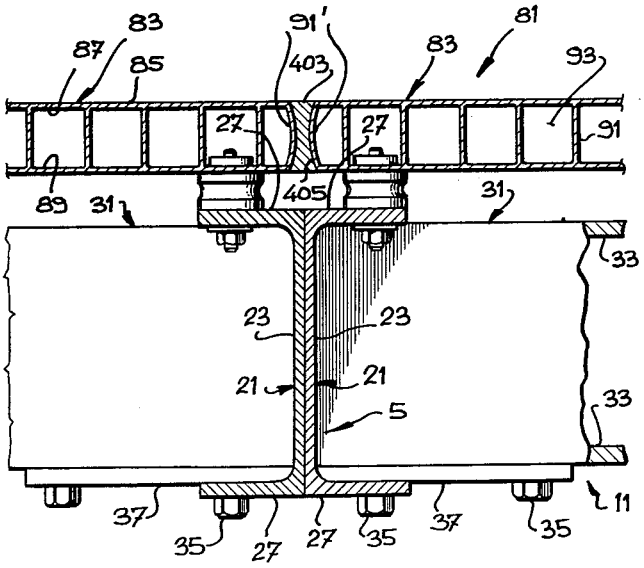
FIG. 10
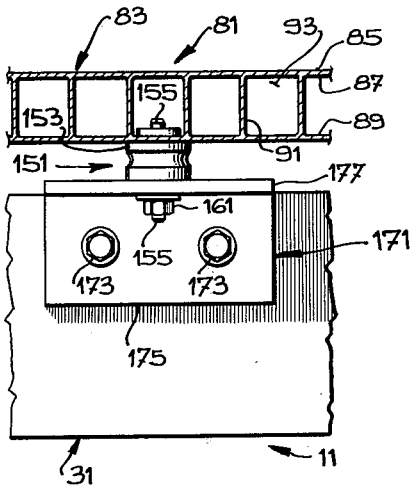
FIG. 11

DISPLACEABLE BUILDING UNIT FOR OFF-THE-WALL GAMES

The present invention relates to a displaceable building unit defining a playing enclosure for use as a court for off-the-wall games.

In the instant specification, the expression "off-the-wall games" is intended to mean such games as hand-ball, squash or racketball and generally any games wherein a ball is thrown against and bounces off a wall.

Existing courts for such off-the-wall games are expensive and require a sizeable investment in land and in the building which defines the playing enclosure. The site selection is limited both by space and cost and, once erected, the courts cannot easily be moved to another site.

It is a purpose of the present invention to provide a building unit suited for off-the-wall games which is inexpensive and simple in construction and erection. It is a further purpose of the present invention to provide a building unit of the above type which is readily displaceable.

An object of the present invention lies in the provision of a building unit of the above type that has at least one end wall and two sidewalls and that can readily be erected within buildings, such as arenas which are normally not used in the summer, to provide facilities for off-the-wall games and thus more fully utilize the arena bulding. Since the unit is capable of being used within an existing building, no roof need of course be provided. However, the unit according to the invention may also have four walls and a full or partial ceiling where particular games to be played require all four walls and a full or partial ceiling. A further object of the invention lies in the provision of a displaceable building unit defining a playing enclosure for use as a court for off-the-wall games requiring at least one wall suitable for the bouncing-off of a ball. The unit comprises a frame made up of at least one end skeleton structure and two side skeleton structures fixed to the end skeleton structure; flat wall panels and resilient means securing the wall panels to the structures on the inside thereof with respect to the playing enclosure, the resilient means detachably connecting the panels to the structures at spaced apart locations. Each panel is a cellular construction which comprises an outer skin spaced from and parallel to the inner skin and a plurality of spaced apart webs extending transversely of the panel between the skins. The panels are disposed on the structures so that the outer surface formed by the panel inner skins is unbroken. The resilient means securing the panels of the ball-bouncing wall project solely toward the outside of the panels with respect to the playing enclosure whereby the inner face of the ball-bouncing wall is flat, continuous and devoid of projecting parts so as to be suitable for use in and off-the-wall game.

According to another object of the invention, there is provided a knock-down portable building unit for use as a court for off-the-wall games requiring at least one wall suitable for the bouncing off of a ball. This building comprises a frame made up of removably interconnected rigid slender members extending in three planes defining one end skeleton structure and two side skeleton structures extending from the end structure and heavy sill members intended to rest unattachedly on the ground and to which the skeleton structures are removably secured from their lower ends, and modular panel members fixed to and inwardly of the skeleton structures over the whole surfaces thereof whereby the structures, sills and panels form a playing enclosure. The panels of at least one of the walls has an inner surface thereof which is flat, continuous, devoid of projecting parts and made of a material having a ball-bouncing property. Such panels of said one wall are made of plastics material defining inner calls and ballast material is contained in the cells to weight the panels down and increase the bouncing property of the one flat surface.

Plastics material is preferred for the making of the wall panels, particularly of the ball-bouncing wall, such as a polycarbonate material marketed under the name "Chemacryl" by Rohm Co. or glass fiber-reinforced plastics material. They may also be made of aluminum, asbestos or the like materials suitable to give a ball-bouncing effect.

A building unit of the above type can be provided with a roof, in either the three or four wall versions, so that the unit can be erected outdoors on available land. It can be erected at tennis clubs of golf courses, for example, to expand the facilities of their members in a simple manner. It may likewise be erected on factory parking lots to provide recreational facilities for the workers.

The building unit is displaceable and is of the knock-down type, that is, it is constructed of a plurality of simple parts that can readily be assembled by unskilled labor using simple tools. It can be temporarily erected and then readily dismantled and moved to a new location, if desired. It is thus ideally suited for use in remote areas such as remote construction sites to provide temporary recreational facilities for the workers.

A specific embodiment of the invention will now be described in detail having reference to the accompanying drawings in which:

FIG. 5 is a cross-section view taken along line 5—5 of FIG. 1;

FIG. 6 is a cross-section view taken along line 6—6 of FIG. 1;

FIG. 7 is a cross-section view taken along line 7—7 of FIG. 6;

FIG. 8 is a detail cross-section view of the building support frame at the junction of the wall, roof, and ceiling;

FIG. 9 is a detail elevation view of the support frame;

FIG. 10 is a cross-section view taken along line 10—10 of FIG. 1;

FIG. 11 is a detail cross-section view of the building sidewall taken between vertical support frame members.

As aforesaid, the building unit of the present invention is particularly suited to off-the-wall games such as squash, hand-ball or racquetball. For some games, the building unit need only comprise one end wall and two side-walls; for other games, a building unit having two end walls and two side walls is required. In some cases the building unit can have a roof, and with or without the roof, a full or partial ceiling.

Figure 1:
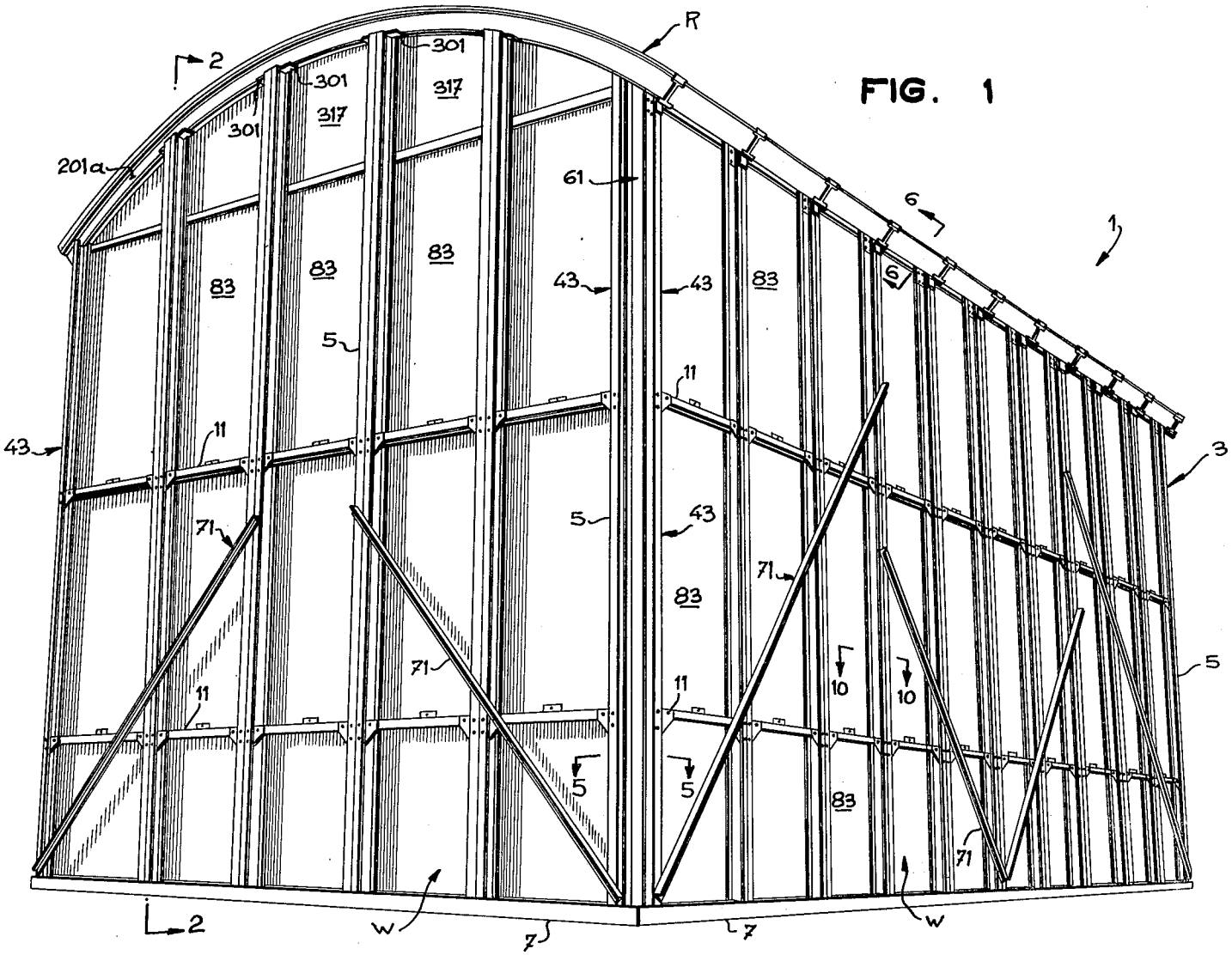
FIG. 1 is a perspective view of the exterior of a games court building made according to the invention.

The building unit 1 of the illustrated preferred embodiment has four walls, a roof and a partial ceiling. As shown in FIG. 1, the building unit 1 has an external support frame 3 formed of skeleton structures defining, with panels hereinafter detailed, the end and side walls "W" of the unit. The unit 1 also has a roof "R" and a ceiling "C" (shown in FIG. 2). The external support frame 3 comprises a series of spaced-apart, vertical column members 5 extending up from horizontal base supports 7. One, possibly two, substantially horizontal, vertically spaced, rows of connectors 11 join the column members 5 together to provide the rigid, skeletal support frame 3. The column members 5 and connectors 11 are made from lightweight metal such as aluminum. The base supports 7 is made from wood.

Figure 2:
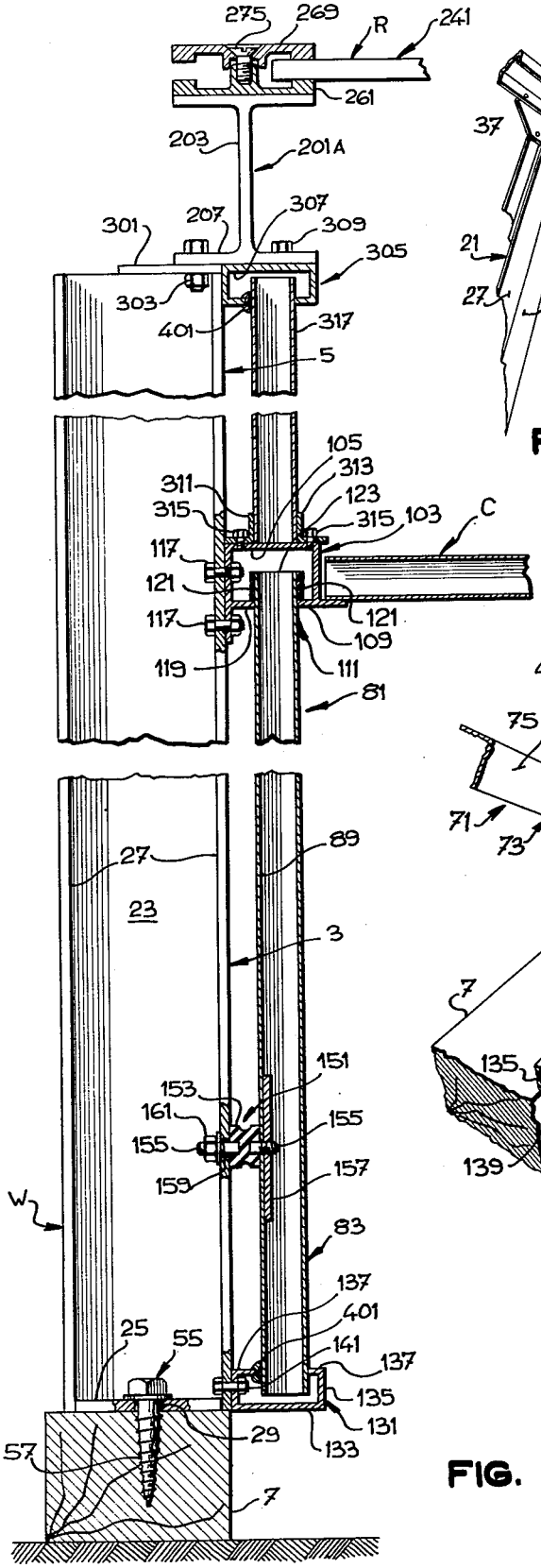
FIG. 2 is a cross-section view of the building taken along line 2—2 of FIG. 1.

In more detail, as shown in FIG. 10, each column member 5 comprises a pair of U-shaped channel members 21 joined together in back-to-back relationship with their webs 23 abutting. A mounting plate 25, extending transverse to the web 23 is fixed to the bottom of each channel 21, located between the flanges 27 of the channel, and attached thereto, and to the web 23 as shown in FIG. 2. Each mounting plate 25 has a central hole 29.

The connectors 11 comprise U-shaped channel members 31 sized to just fit between the flanges 27 of vertical channels 21. The horizontal channel members 31 are connected via their flanges 33 to the flanges 27 of channels 21 with fastening bolts 35. Generally triangular reinforcing plates 37 are provided on at least one side of each connection of a horizontal channel 31 to a vertical channel 21 to strengthen the frame 3 as shown in FIG. 9. The plate 37 is positioned between flanges 33 and 27 of channels 31 and 21 respectively and attached with fastening bolts 35 at each corner of the plate 37.

Figure 4:
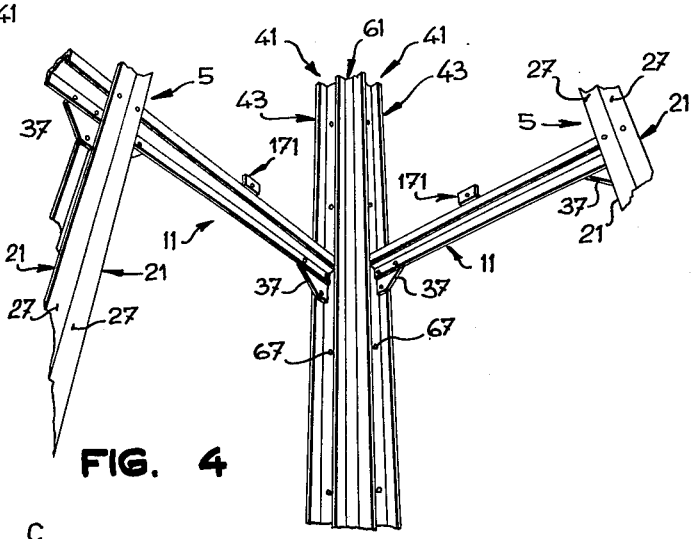
FIG. 4 is a perspective view of a portion of an interior corner of support frame.
Figure 3:
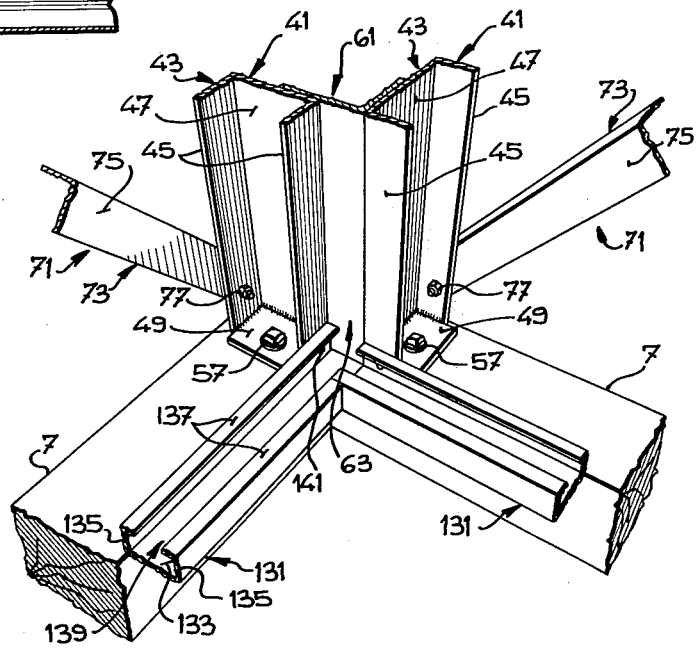
FIG. 3 is a perspective view of an interior bottom corner of the support frame of the building.

Each end of a wall "W" is defined by frame 3 with an end column member 41 as shown in FIGS. 3 to 5. End column member 41 comprises a single U-shaped channel member 43 with its flanges 45 directed toward adjacent intermediate column members 5 in the wall "W" and its web 47 closing off the wall. A mounting plate 49, similar to mounting plates 25, is fixed to the bottom of channel 43 between flanges 45 and web 47. A central hole (not shown) is provided in plate 49.

The frame 3 is erected by fastening the vertical column members 5 and 41 defining each wall "W" to the horizontal base supports 7. Fastening means 55, such as wood screws 57 are used to connect each column 5 and 41 to base support 7. The screws 57 pass through the holes in mounting plates 25, 49. At the same time, connectors 11 are bolted with bolts 35 to the column members 5 and 41.

At each corner of the building unit 1, as shown in FIG. 5, a tie member 61 is used to join the walls "W" together. The tie member 61 shown is a vertical angle member 63 with its flanges 65 connected by bolts 67 to the webs 47 of channels 43 defining the ends of the walls "W" at the corner.

If desired, for added rigidity, diagonally extending reinforcing members 71 can be provided on the frame 3. The members 71 shown are angle members 73 spanning several column members 5 and 41, and attached thereto, along one flange 75, by suitable fastening means, such as bolts 77.

The frame 3, defining walls "W", supports a panel structure 81 on the inside of the building unit. The panel structure 81 shown is made of a plurality of modular wall panels 83, that is panels generally of identical size, each having a smooth inner surface 85. Each panel 83 is extruded from suitable plastics material such as fiber glass with parallel inner and outer skins 87, 89 and a plurality of spaced-apart, transverse webs 91 defining vertical chambers 93. The outward surface of inner skin 87 provides a smooth ball-bouncing surface 85. The end webs 91' form the edges of panels 83 and are slightly rounded. A suitable panel material is a polycarbonate material marketed under the name "Chemacryl" manufactured by Rohm Co., However, the cellular panels may also be made of aluminum, asbestos or other materials that will provide the ball-bounding quality needed.

The panels 83 are supported by frame 3 in a vertical position with their end edges 91' vertical and closely adjacent. Frame 3 has support means 101 on the inner side of the frame, at or near the top edge from which the panels 83 are suspended. The support means 101, as shown in FIGS. 6 and 8 preferably comprises a generally U-shaped channel 103, having a web 105 and side flanges 107, 108. Support flanges 109 extend toward each other from the ends of side flanges 107, 108 defining a gap 111 between their free ends. One side flange 107 has a downward extension 113. The other side flange 108 has a horizontal extension 115 as a projection of flange 109. The channel 103 is attached to the column members 5, 41 horizontally with bolts 117 passing through flange 107 and its extension 113, and flanges 27, 45 on channels 21, 43 respectively.

Each panel 83 has a support strip 121 adjacent its top edge 123 on the outer surface of each wall 87, 89 as shown in FIGS. 2 and 6. Each panel 83 is mounted on frame 3 by sliding its top portion into channel 103, through gap 111 and suspending it so that support strips 121 rest on support flanges 109.

The bottom of each panel 83 rests within another U-shaped bottom channel 131 supported by frame 3 as shown in FIGS. 2 and 3. Channel 131 has a web 133 and side flanges 135. Support flanges 137 extend toward each other from the top edges of side flanges 135 defining a gap 139 therebetween. Channel 131 is attached to the bottom of column members 5, 41 with bolts 141 passing through one side flange 135 and with gap 139 opening upwardly. The bottom portion of panel 83 passes through gap 139 to rest within channel 131.

Each panel 83 is supported by intermediate support means 151 on frame 3 at spaced apart locations over the area of the panel. The support means 151 shown particularly in FIG. 2 comprise resilient bushings 153 having a threaded pin 155 projecting from each end thereof. One pin 155 passes through a hole in the outer wall 89 of panel 83 and screws into a plate 157 positioned within a chamber 93 in panel 83 (FIG. 2). The other pin 155 passes through a hole 159 in a flange 27 of a column member 5 and is fastened thereto with a nut 161. Where additional support is required for each panel 83, angled support brackets 171 (FIG. 11) can be provided midway between the column members 5. The brackets 171 are mounted on the web of connectors 11 by bolts 173, passing through one flange 175. The panel 83 is connected to the other flange 177 of bracket 171 by a support means 151.

Support means 151 are employed to support panels 83 from frame 3 since the resilient bushings 153 allow for some relative expansion or contraction movement between the frame 3 and panels 83 as the temperature changes. The panels 83 are normally made from thermolastic material as previously stated, and the frame 3 of the described embodiment is made lightweight metal such as aluminum, as previously stated. The panels 83 and frame 3 thus have different thermal coefficients of expansion. The bushings 153 therefore permit slight dimensional variations with temperature changes.

If the building unit 1 is to be used outdoors, a roof "R" is employed which comprises a plurality of curved arches 201 extending between the tops of the sidewalls "W" of the building unit 1. Each arch 201, as shown in FIGS. 7 and 8, comprises an I-beam having a central web 203 and a top and bottom flange 205, 207. Each arch 201 extends between opposed column members 5 in the sidewalls "W". The tops 209 of the column members are sloped to have the ends of the arches 201 sit flat thereon. A pair of angle brackets 211 attach each arch end to the top of a column member 5. Each bracket 211 has one flange 213 attached by bolts 215 to the abutting webs 23 of channels 21 comprising each column member 5. The other flange 217 of each bracket 211 is attached to the bottom flange 207 of arch 201 by bolts 219. As shown, an additional bracket 221 is used to attach each arch end to a column member 5. Each brackeet 221 has one flange 223 attached by bolts 225 to the outer flanges 27 of channels 21 making up a column member 5. The other flange 227 of bracket 221 is attached by bolts 229 to that portion of bottom flange 207 of arch 201 which projects past the column member 5.

Roof panels 241 (FIG. 7), similar in construction to wall panels 83, close the roof "R". The panels 241 are mounted on the top of arches 201. Each roof panel 241 comprises a top wall 243, a bottom wall 245 and transverse, spaced-apart webs 247 extending between the walls 243, 245. A bottom mounting bracket 261 is fixed by bolts 263 to the top flange 205 of each arch 201. The bottom bracket 261 has sealing strips 265 mounted thereon adjacent its edges 273. The roof panels 241 are mounted on the sealing strips 265 of the bottom bracket 261. Top bracket 269 is then mounted on top of the roof panels 241 with the sealing strips 271 pressed against the panels. The top bracket 269 is attached with screws 275 to the bottom bracket 261 clamping the panels 241 between them. The screws 275 are located between the edges 249 of adjacent panels 241.

As shown in FIG. 6, each corner of each panel 241 is also fastened to the end of each arch 201 by a clip 281 having two arms 283, 285 which slip over the end of the panel 241. The clip 281 is attached to a bracket 287 by a bolt 289 which bracket 287 is attached by suitable means (not shown) to the bottom of top flange 205 of arch 201.

Each end wall "W" of the building unit 1 extends up from the ceiling support channel 103 to the bottom of the roof arch 201. The column members 5 extend up to the end arch 201*a*, as shown in FIGS. 1 and 2. Mounting plates 301 are fixed to the top of the corresponding column members and arch 201*a* is attached to plates 301 by bolts 303 along the outside part of its bottom flange. A top, U-shaped channel 305, identical to bottom channel 131 is attached by its web 307, via bolts 309, to the inside part of bottom flange 207 of arch 201*a*. On the other hand, angle members 311, 313 are attached by bolts 315 to the web 105 of the support channel 103. Panels 317, similar in construction to roof panels 241 and wall panels 83 but cut and shaped so as to fit between top channel 305 and angle members 311, 313, close the end walls "W" between the top of end wall panels 83 and the roof arches.

Figure 12:
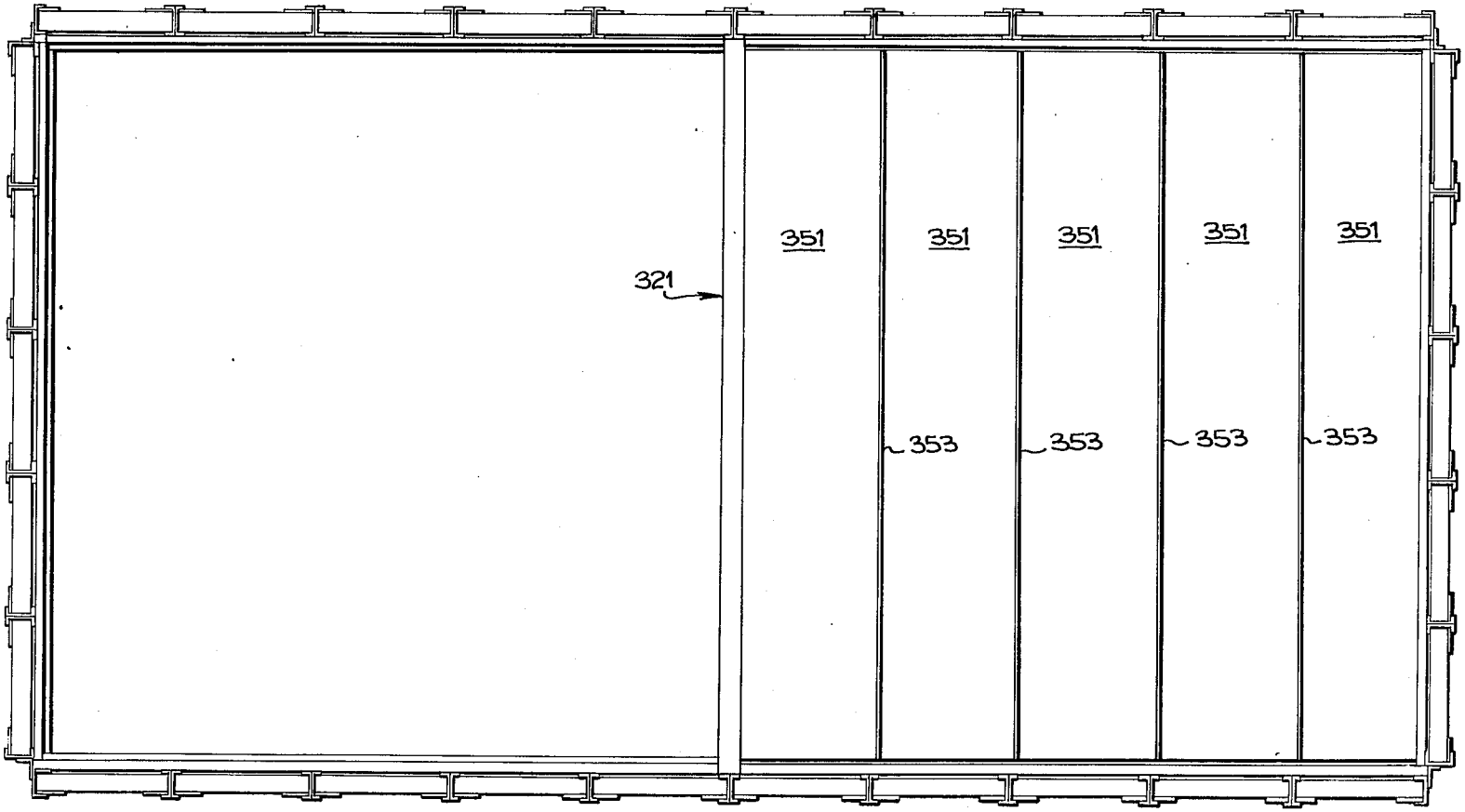
FIG. 12 is a plan view of the building showing a partial ceiling frame, with ceiling panels removed.

Some ball games require a flat ceiling "C" extending over at least a part of the length of the building unit from its front wall "W". The ceiling "C" has a central I-beam joist member 321 extending between the side walls "W" and attached to the roof arches 201 as shown in FIGS. 8 and 12. The I-beam member 321 has a top flange 323, a bottom flange 325, and a central web 327. The ends 329 of member 321 are notched in their bottom corner 331 to fit over mounting channel 103 with the top of bottom flange 325 level with the top of flange 115 on channel 103. Pairs of brackets 335, each having a first flange 337 and a second flange 339 connect each end 329 of each member 321 to arch 201. Bolts 341 connect first flange 337 to web 327 and bolts 343 connect second flange 339 to the bottom flange 207 of arch 201. Ceiling panels 351, similar in construction to wall panels 83 and roof panels 241 are mounted on bottom flanges 325 of ceiling joist member 321 and on flange 115 of support channel 103 thus closing off half of the ceiling "C".

The ceiling panels 351 are also held by the horizontal flanges 355 of a series of intermediate invested T beams 353 (FIGS. 6 and 12) of which the web ends are secured in any known manner to the outward flanges 115 of members 103. The last outward panels 351 (right of FIG. 12) also rest on the lower flange of an outward I beam, not detailed, similar to I beam 327 of FIG. 12.

Suitable sealing means are provided to close the building to weather if it is to be used outside. As shown in FIG. 2 sealing strips 401, made from suitable resilient material, can be mounted on flanges 137 of support channels 131 to bear against panels 83. In addition as shown in FIG. 10, sealing means 403 are provided between the adjacent edges 91′ of wall panels 83. These sealing means 403 comprise a resilient molded member, or resilient waterproof material, extruded in the gap 405 between the panels. The sealing means 403 can be eliminated if the unit 1 is erected indoors. The gaps 405 are narrow enough to minimize any interference in play when the unit is used as court for wall games.

It will be seen that the unit 1 is easily assembled using lightweight parts. In particular, the panels 83 and 241 are very light yet strong due to their construction. The cellular construction also provides good insulation qualities when the unit is used outdoors. The unit 1 can be easily assembled indoors or outdoors, with or without a roof and/or ceiling. The unit 1 is portable, if desired, or it can be left permanently erected. Any suitable floor can be employed depending on the use the unit is to be put to.

The unit 1 can be provided with heating, and, if desired, ventilating units to provide a complete building unit. The cellular construction of the walls provides good insulation qualities.

The units 1 can also be arranged in a row in spaced-apart relation. In this arrangement, the sidewall frames on each unit can be constructed to support wall panels on both sides. The units are spaced apart so that the wall panels on the outside of adjacent units form the sidewalls of another court between the units. This court can be completed by adding one or two end walls extending between adjacent units.

The column members, roof arches, and ceiling joists are spaced apart to provide modular distances therebetween such as two or four feet. The wall, roof and ceiling panels are also provided in modular widths. The size of court can therefore be easily changed.

The rebound characteristics of the cellular wall panels are generally satisfactory for the games to be played. However, if better rebound characteristics are desired, the chambers 93 within the wall panels may be filled with sand or other suitable material. The chambers 93 may also be sealed at the bottom and filled with water, eventically with an antifreeze material if used in the winter. Such weighted down panels also absorb sound better as well as reduce vibration, particularly where the unit is located outside and is exposed to winds.

I claim:

1. A displaceable building unit defining a playing enclosure for use as a court for off-the-wall games requiring at least one wall suitable for the bouncing-off of a ball, comprising:

a frame made up of at least one end skeleton structure and two side skeleton structures fixed to said end skeleton structure;

flat wall panels and resilient means securing said wall panels to said structures on the inside thereof with respect to said playing enclosure; said resilient means detachably connecting said panels to said structures at spaced apart locations;

wherein each panel is a cellular construction comprising an inner skin, an outer skin spaced from and parallel to said inner skin, and a plurality of spaced apart webs extending transversely of the panel between said skins, said panels being disposed on said structures so that the outer surface formed by said panel inner skins is unbroken, and wherein said resilient means detachably securing said panels of said ball-bouncing wall project solely toward the outside of said panels with respect to said playing enclosure whereby the inner face of said ball-bouncing wall is flat, continuous and devoid of projecting parts so as to be suitable for use in an off-the-wall game.

2. A building unit is claimed in claim 1 wherein said skeleton structures comprises slender frame members, and means for detachably connecting the frame members together.

3. A building unit as claimed in claim 2 wherein said skeleton structures includes generally horizontal support members extending about the top thereof, said panels being suspended from said support members.

4. A building unit as claimed in claim 2 wherein said skeleton structures include a plurality of vertical, spaced-apart column members, a roof on the building unit, the roof having a plurality of arch members, each arch extending between, and attached to, opposed pairs of column members in the side walls of the skeleton structures.

5. A building unit as claimed in claim 4 including a ceiling, the ceiling having a plurality of joist members, each extending between and attached to the ends of an arch member.

6. A building unit as claimed in claim 1, wherein said resilient means are mounted through the outer skins of said panels between adjacent webs.

7. A knock-down portable building unit for use as a court for off-the-wall games requiring at least one wall suitable for the bouncing off of a ball, said building comprising:

a frame made up of removably interconnected rigid slender members extending in three planes defining one end skeleton structure and two side skeleton structures extending from said end structure and heavy sill members intended to rest unattachedly on the ground and to which said skeleton structures are removably secured from their lower ends;

modular panel members fixed to and inwardly of said skeleton structures over the whole surfaces thereof whereby said structures, sills and panels form a playing enclosure;

wherein said panels of at least one of said walls has an inner surface thereof which is flat, continuous, devoid of projecting parts and made of a material having a ball-bouncing property, and wherein said panels of said one wall are made of plastics material defining inner cells and wherein ballast material is contained in said cells to weight said panels down and increase the bouncing property of said one flat surface.

8. A building as claimed in claim 7, wherein said panels of said one flat wall are each made of an inner and an outer skin integrally interconnected by spaced vertical webs whereby to define vertical chambers into which said ballast material is contained and wherein said panels are made of extruded plastics material.

* * * * *